US010023277B1

(12) United States Patent
Oberholtzer

(10) Patent No.: US 10,023,277 B1
(45) Date of Patent: Jul. 17, 2018

(54) STERN RUNNING LIGHTING APPARATUS

(71) Applicant: T-ZER DESIGNS, LLC, Orangeburg, SC (US)

(72) Inventor: J. Linford Oberholtzer, Orangeburg, SC (US)

(73) Assignee: T-ZER DESIGNS, LLC, St. Matthews, SC (US)

( * ) Notice: Subject to any disclaimer, the term of this patent is extended or adjusted under 35 U.S.C. 154(b) by 0 days.

(21) Appl. No.: 15/270,108

(22) Filed: Sep. 20, 2016

Related U.S. Application Data

(60) Provisional application No. 62/221,982, filed on Sep. 22, 2015.

(51) Int. Cl.

| | |
|---|---|
| ***B63B 21/26*** | (2006.01) |
| ***B63B 45/04*** | (2006.01) |
| ***B63B 45/06*** | (2006.01) |
| ***F21V 23/04*** | (2006.01) |
| ***F21V 23/00*** | (2015.01) |
| ***F21V 31/00*** | (2006.01) |
| ***F21S 8/00*** | (2006.01) |
| *F21Y 115/10* | (2016.01) |

(52) U.S. Cl.
CPC ..... *B63B 45/04* (2013.01); *B63B 21/26* (2013.01); *B63B 45/06* (2013.01); *F21S 8/003* (2013.01); *F21V 23/001* (2013.01); *F21V 23/04* (2013.01); *F21V 31/00* (2013.01); *F21Y 2115/10* (2016.08)

(58) Field of Classification Search
CPC ..... B63B 21/30; B63B 45/04; B63B 45/06; B63H 25/48; B63H 11/11; F21V 23/001; F21V 23/04
See application file for complete search history.

(56) References Cited

U.S. PATENT DOCUMENTS

| | | | | |
|---|---|---|---|---|
| 2,995,650 | A * | 8/1961 | Kiekhaefer | B63B 45/04 340/984 |
| 4,884,173 | A * | 11/1989 | Cassidy | B60Q 1/24 362/243 |
| 8,430,523 | B1 * | 4/2013 | Smith | F21V 29/004 362/235 |
| 2007/0069963 | A1 * | 3/2007 | Sherwood | H01Q 1/084 343/711 |
| 2011/0209653 | A1 * | 9/2011 | Bernloehr | B63B 21/26 114/230.13 |

(Continued)

OTHER PUBLICATIONS

Webpage Talon Shallow Water Anchors, Talon Locked and Loaded; from www.minnkotamotors.com/shallow-water-anchors/talon/; Nov. 17, 2016.

*Primary Examiner* — Stephen P Avila
(74) *Attorney, Agent, or Firm* — Nexsen Pruet, LLC; Michael A. Mann

(57) ABSTRACT

A stern running light is pivotally attached to the mast of a shallow water anchor system thereby avoiding the need for a separate stern running light. The top end of the mast holds both a pivotable cluster of LED lights that emit light in a 360 degree horizontal plane and, below it, a flood light in a clear plastic housing for task lighting within the fishing boat to which the mast is attached. A power cord for the stern runs to the battery for the mast from the stern running light and flood light. The mast of the shallow water anchor is at a height suitable to meet stern running light height requirements and the use of white LEDs meets light visibility requirements.

10 Claims, 6 Drawing Sheets

(56) References Cited

U.S. PATENT DOCUMENTS

2015/0274267 A1* 10/2015 Deven ..... B63B 45/04
362/477
2016/0244129 A1* 8/2016 Cromartie ..... B63B 21/26

* cited by examiner

STERN RUNNING LIGHTING APPARATUS

TECHNOLOGICAL FIELD

The disclosure relates generally to boat lighting and to stern running lights in particular.

BACKGROUND

Small fishing boats operating in shallow water maintain their position using an anchor. Anchors are available that are easier to deploy and can also inform the user of the depth of the water, which may change with the tide or on the addition of surface water runoff. This type of anchor includes a telescoping spike, such as that made by Minn Kota and sold under the trademark TALON. The telescoping spike anchor allows the boat to rise and fall and prevents drift.

Because such a device may deploy a 2.4-3.0 meter (10 or 12 feet) telescoping spike below the boat, a mast that holds the telescoped spike sections prior to their deployment extends above the deck of the boat deck. The controls for the spike and its deploying motor are mounted to the side of the mast.

Shallow water fishing may take place in dim light or at night and under conditions that require the use of a stern running light, a 360-degree white light, so the boat can be seen even when it is stationary by those in other boats on the water. A stern running light must meet certain requirements specified by the US Coast Guard including general visibility and height above the boat deck, namely, at least one meter.

Altogether, fishing gear, provisions, lighting for night fishing, stern running lights, and a spike anchor form a considerable amount of gear, particularly for a small fishing boat. A more efficient way to manage this gear for a night-fishing trip would be an advantage to those who enjoy night fishing.

SUMMARY

The apparatus disclosed includes a boat with an interior, a bow, a stern, and an anchor mast mounted to the stern of the boat. The top end of the mast carries lighting rather than the cap that normally terminates the top end of the mast. A power line is connected between a battery and the lighting on top of the mast. The bottom end of the mast carries a telescoping spike operated by a motor on the mast that moves the spike between a stored position inside the mast and a deployed position extending downward from the mast. The motor, which is carried by the mast, is also connected to the battery. The spike is dimensioned and operative to hold the boat in position in shallow water. A light switch activates and deactivates the lighting. Operation of the telescoping spike is independent of the light carried by the mast.

An aspect of the disclosure is the lighting that includes a stern running light attached to the top to the mast. The stern running light pivots between a stored position and a deployed position and is activated when moved to the stored position.

Another aspect of the disclosure is the lighting includes two lights, namely, a stern running light and a flood light. The stern running light is a 360-degree light comprising plural light-emitting diodes (LEDs), and the flood light provides task lighting directed toward the interior of the boat. The running light and flood light may both be clusters of white LEDs that, in the case of the stern running light, meet Coast Guard brightness requirements for stern running lights, and, when used in the flood light, provide ample task lighting for those in the interior of the boat.

An aspect of the disclosure is that the stern running light on the top end of the mast is at least one meter higher than the deck of the boat so that it meets stern running light requirements for position as well as brightness.

Still another aspect of the disclosure is that the flood light is controlled by a separate switch and from that of the stern running light.

Those skilled in night fishing by boat and the legal requirements for operating a boat will appreciate the many features of the disclosed apparatus from a careful reading of the Detailed Description accompanied by the following drawings.

DETAILED DESCRIPTION

Figure 1:
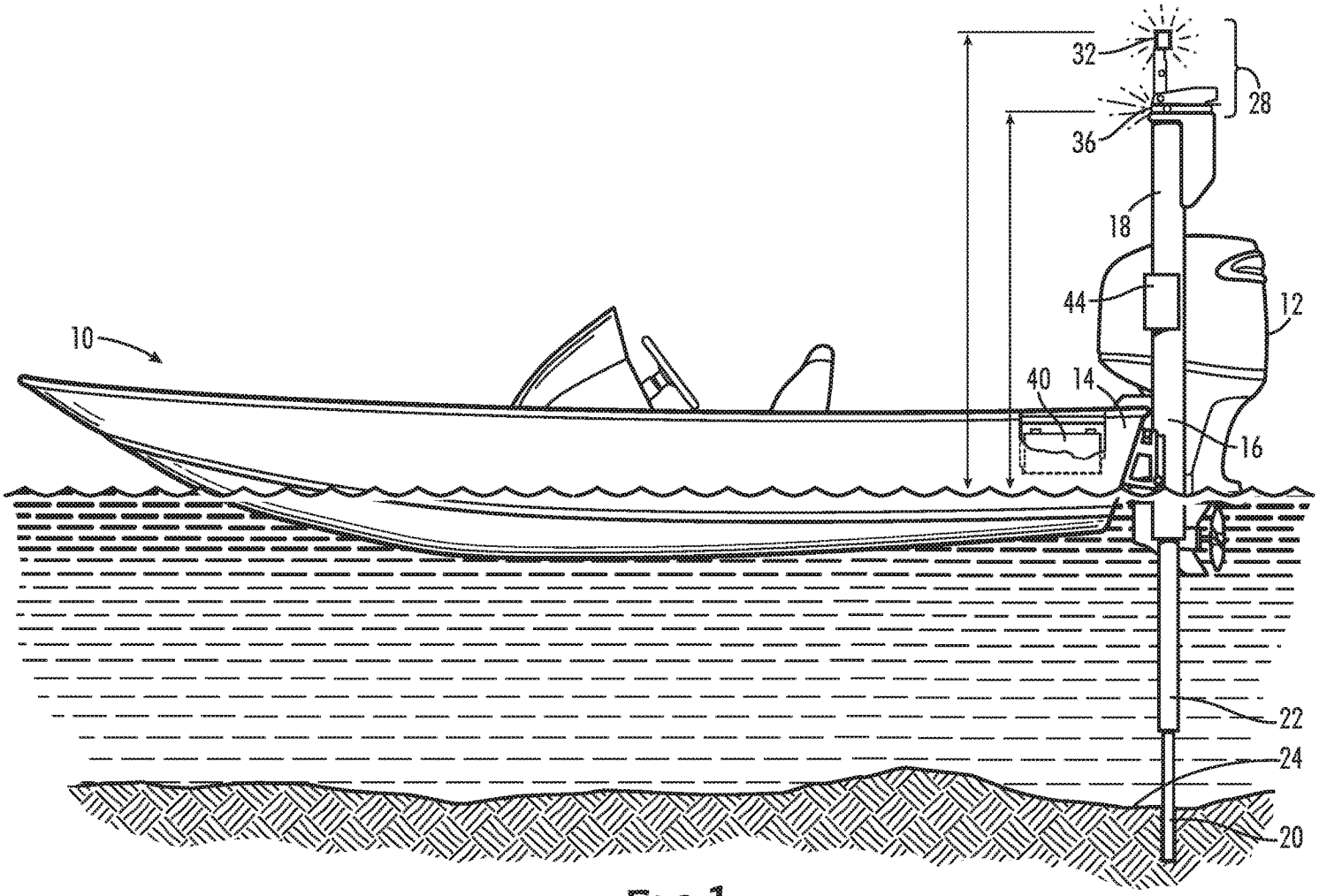
FIG. 1 is a partially cutaway, left side view of a fishing boat with a deployed shallow water boat anchor and a stern running light and a flood light, according to an aspect of the disclosure.
Figure 2:
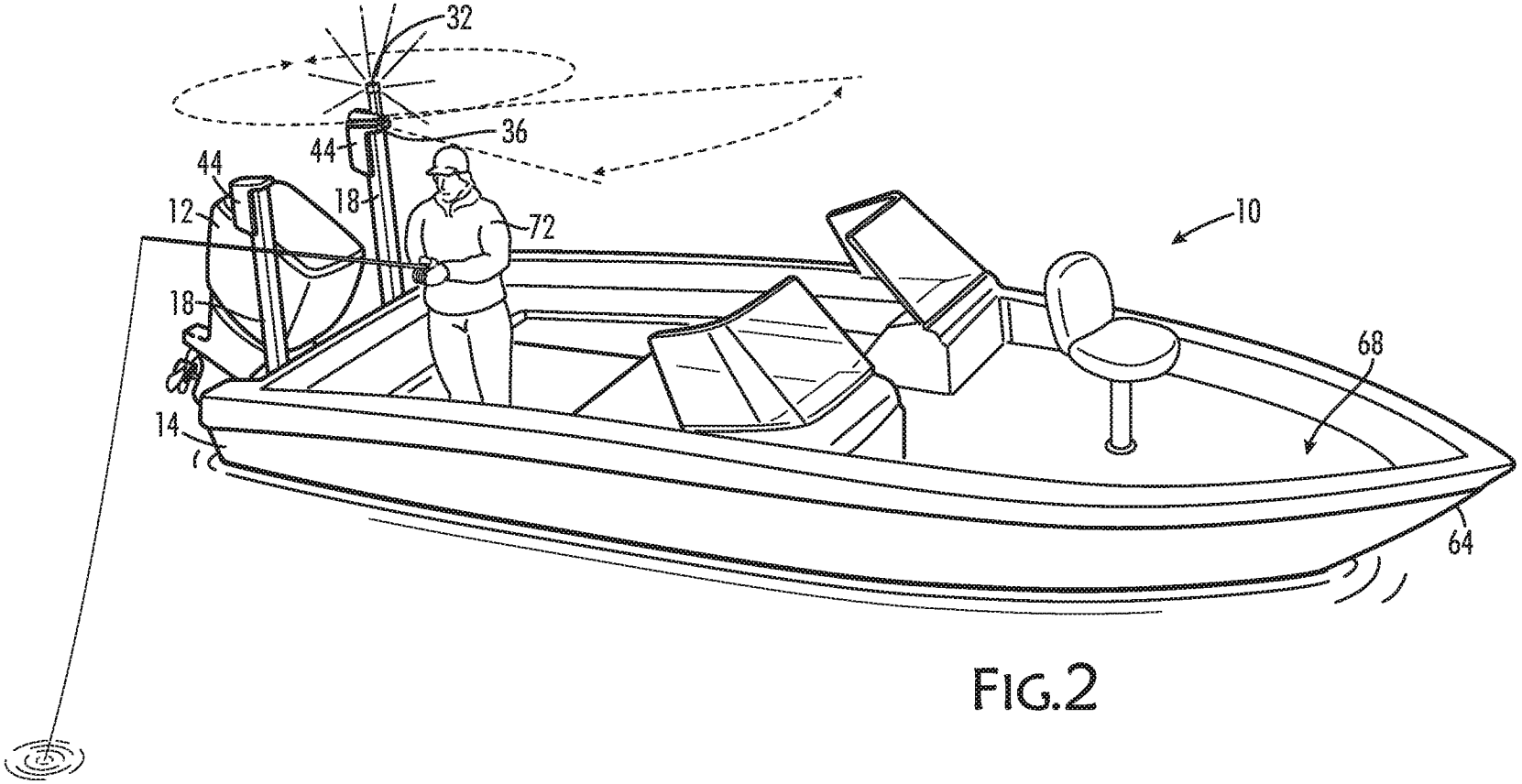
FIG. 2 is a right side perspective view of the boat of FIG. 1 showing a user fishing and the 360 degree light beam from a stern running light and forward directed light beam from a flood light, according to aspects of the disclosure.

Referring now to FIGS. 1 and 2, a watercraft is shown as a motorized, propeller-driven fishing boat 10 that includes an outboard motor 12 mounted to a stern 14 and two shallow water boat anchors 16 mounted to the stern 14 lateral to outboard motor 12. The shallow water boat anchor 16 comprises at least one mast 18 with a spike 20 affixed to a telescoping cylindrical tube 22 that can extend a total of 2.4-3.0 meters (10 or 12 feet) into the bottom surface 24 of the body of water 26 to hold fishing boat 10 in position and prevent drift.

Fishing boat 10 has a light system 28 at the top of mast 18 that includes a stern running light 32 and a flood light 36. Light system 28 is connected to a battery 40 that is also used to start outboard motor 12 and to provide power to a motor 44 for mast 18.

Stern running light 32 directs light in a 360° horizontal plane, parallel to the surface 48 of the water 52 and elevated to a height of at least one meter as indicated by line 56 above deck 60. Stern running light 32 may comprise a cluster of white, ultra-bright, light-emitting diodes (LEDs) which can be seen up to two miles away, and thus meeting US Coast Guard requirements. LEDs are also long-lived, compact, cooler, and use less energy than incandescent lights.

Flood light 36 directs a beam of light from stern 14 of boat 10 toward bow 64 that is wide enough to illuminate the interior 68 of fishing boat 10 with task lighting. Task lighting is intended for illuminating tasks performed by the user 72, such as rigging a fishing line, cutting bait, and so on. Flood light 36 may be provided by LEDs, with the number and brightness of the LEDs being selected to provide the appropriate amount of task lighting.

Figure 3:
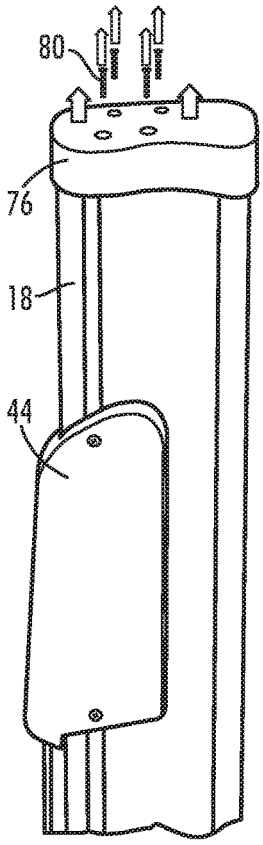
FIG.3 PRIOR ART
FIG. 3 is a side perspective view showing a prior art mast of a shallow water boat anchor with its cap being removed, according to an aspect of the present disclosure.
Figure 4:
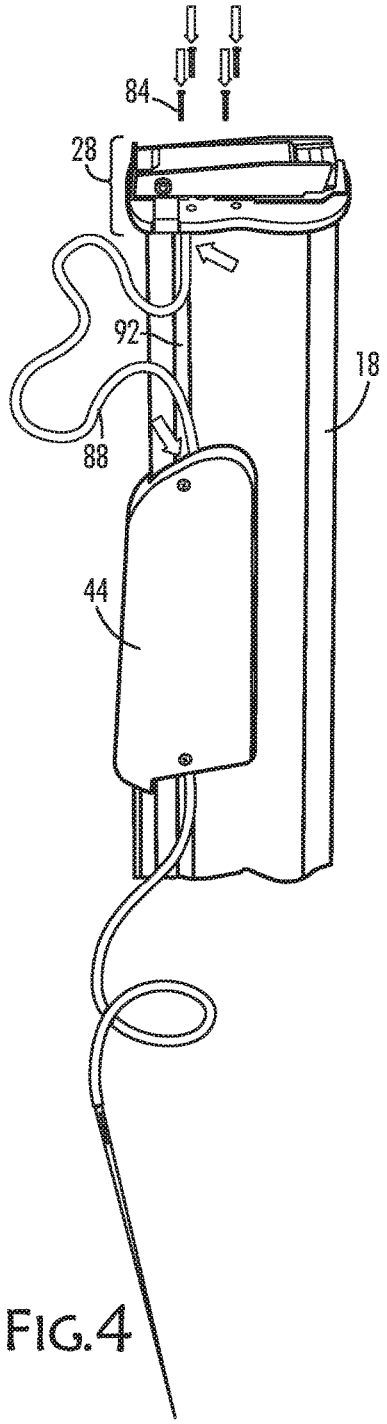
FIG. 4 is side perspective view of the mast of a shallow water boat anchor with the present lighting system being installed in place of the removed cap and with the wiring for the light being threaded between the mast and the anchor motor, according to an aspect of the disclosure.
Figure 5:
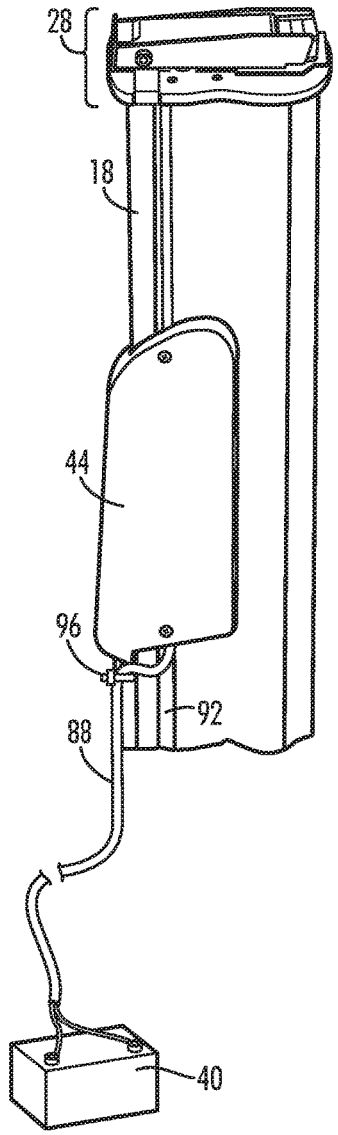
FIG. 5 is a perspective view of the mast of the shallow water boat anchor with the present lighting system in position and wired to the battery, according to an aspect of the disclosure.

As shown in FIGS. 3-5, to modify a typical shallow water boat anchor 16, a cap 76 on top of the mast 18 is removed and replaced by light system 28. FIG. 3 shows cap 76 being unfastened after the removal of four screws 80 that secured it to mast 18. Light system 28 is then mounted to mast 18 in place of cap 76 by affixing it to the top of the mast 18 with screws 84, as seen in FIG. 4, which screws 84 may be a different length than that of screws 80 to accommodate light system 28 compared to cap 76. As an alternative, light system 28 may be affixed to mast 18 by the use of adhesives.

A power cord 88 running from stern running light 32 and flood light 36 may be threaded between mast 18 and motor 44 when run to battery 40 particularly if mast 18 has an axial channel 92. Power cord 88 may fit conveniently into channel 92. FIGS. 4 and 5 show a power cord 88 running from the bottom of light system 28, threading down along mast 18 and terminating at battery 40, which powers light system 28 and shallow water boat anchor 16. Clips 96 may be used to secure the power wire 38 to axial channel 92 of mast 18. Battery 40 may be a 12 volt, direct-current battery.

Comparison of FIG. 1 and FIG. 5 will show stern running light 32 in two different positions. Stern running light 32 pivots between a horizontal, stored position as seen in FIG. 5, and a vertical, deployed position, as seen in FIG. 1. Stern running light 32 is pivoted between the stored and deployed positions by first pressing button 100 to unlock stern running light 32 from light system 28 and then moving stern running light 32. Releasing button 100 allows stern running light 32 to lock again when in either the stored or deployed position.

Figure 6:
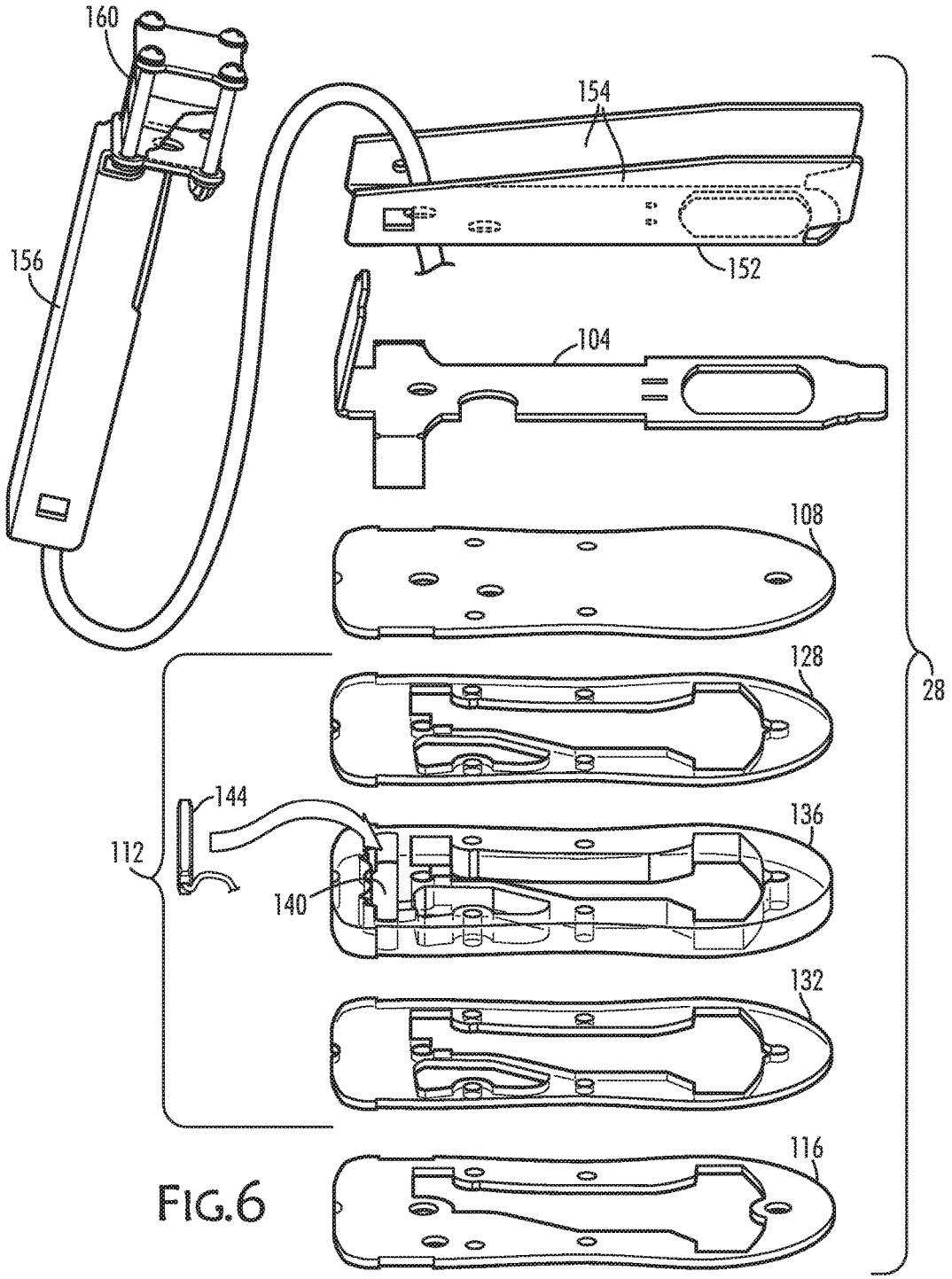
FIG. 6 is a perspective, side, exploded view of the components of the boat lighting system, according to an aspect of the disclosure.

FIG. 6 shows an exploded view of the light system 28. Light system 28 comprises a top cover 104, a lamp lid plate 108, a LED lamp housing 112, and a lamp lower plate 116. Top cover 104, lamp lid plate 108 and lamp lower plate 116 may be made of metal, such as aluminum. The components of the light system 28 are fastened together with screws 84 through corresponding holes 124 in the top of mast 18.

LED lamp housing 112 holds the LEDs that provide illumination for flood light 36. LED lamp assembly includes a top 128 and a bottom 132 with a frame 136 between them that has a recess 140 dimensioned to receive first LED set 144 that provides illumination for flood light 36. Top 128, bottom 132 and frame 136 may be made of clear acrylic and, when secured together, provide a water-tight housing for first LED set 144.

Top cover 104 grips lamp lid plate 108 and lamp lower plate 116, with LED lamp housing 112 between them. Top cover 104 also includes a stop 106, the function of which will be described below. A second bracket 152 has a U-shape for receiving a lamp arm 156, which holds a second LED set 160. The U-shape of second bracket 152 arises by forming upstanding flanges 154 that oppose each other. Lamp arm 156 is pivotally attached to second bracket 152 using a pivot latch mechanism 164. Lamp arm 156 is limited in its pivot from the stored position to the deployed position by stop 106.

Figure 7:
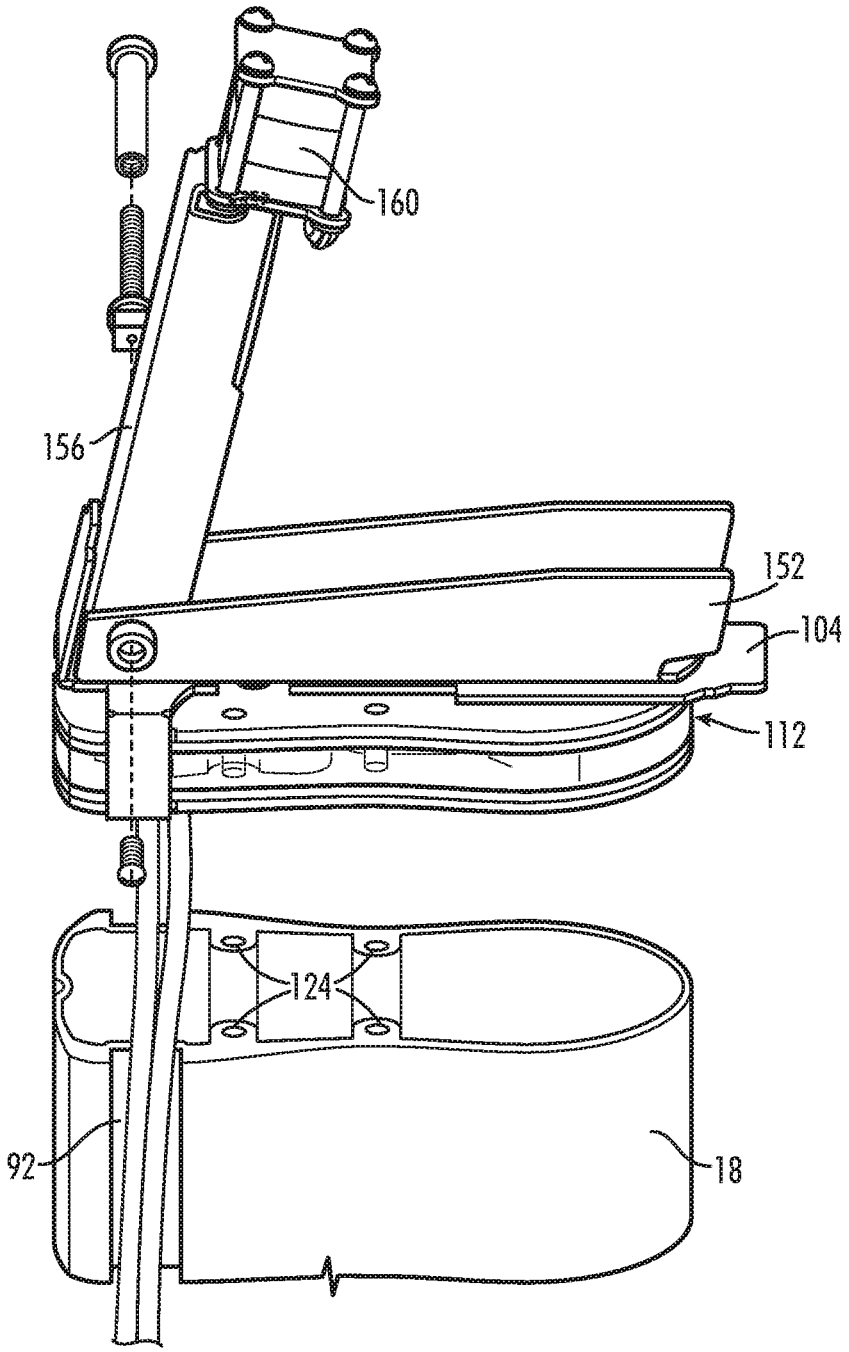
FIG. 7 is a detailed, partially exploded, perspective view of the lamp arm and its connection to the LED lamp housing, according to an aspect of the disclosure.

As best seen in FIG. 7, pivot latch mechanism 164 includes a two-part shaft with a first part 172 being hollow and a second part 176 being solid. A compression spring (not shown) is inside the first part 172 and is pressed on the by second part 176 when it is inserted into the first part 172 First part 172 and second part 176 can be squeezed together against the compression spring.

At the end of second part 176, a square nut 180 is attached. A ring 184 with an outer diameter larger than square nut 180 is attached to the square nut 180 by a screw 188 that threads to the interior of the square nut 180 through the center of ring 184.

Upstanding flanges 154 of second bracket 152 and lamp arm 156 have opposing square holes 192, 196, respectively, that correspond with each other and with square nut 180 in size and relative alignment, so that square nut 180 can fit through square holes 192, 196, and to thereby lock second bracket 152 and lamp arm 156 together when square nut 180 is seated in square holes 192, 196. By pressing on the ring 184, square nut 180 can be moved axially, out of square holes 192, 196 of upstanding flange 154 of second bracket 152 and of lamp arm 156 so lamp arm 156 can pivot with respect to second bracket 152. Releasing ring 184 allows square nut 180 to again seat in square holes 192, 196 so that second bracket 152 and lamp arm 156 are again locked together, either in the stored position (FIG. 5) or the deployed position (FIG. 1). Movement of lamp arm 156 from the stored to the deployed position acts as a stern running light switch to turn on second LED set 160.

Figure 8:
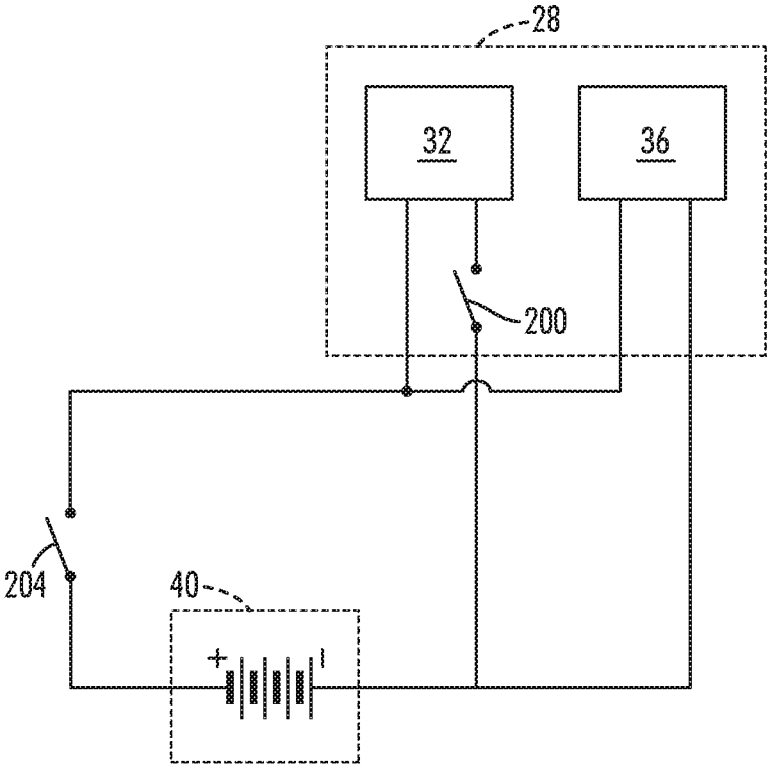
FIG. 8 is a schematic of the wiring for light system, according to an aspect of the disclosure.

In FIG. 8, there is illustrated a simple wiring diagram for the present lighting system 28 showing stern running light 32 and flood light 36 connected to battery 40 and to a switch 200 which may be located with the instrumentation of boat 10 or other convenient place on boat 10, and an additional switch 204 that may be located on light system 28 and is closed by the pivoting of stern running light 32 to the deployed position from the stored position. It will be clear that the two circuits are shown as separate circuits and are separately activated.

What is claimed is:

1. A shallow water anchor, comprising:

a mast with a telescoping spike, said mast having a top;

a power wire, said power wire operable to be connected to a battery;

a motor connected to said power wire and operable to move said telescoping spike of said mast;

a flood light mounted to said top of said mast;

a running light mounted to said top of said mast, said running light connected electrically in parallel to said power wire; and switches connected to said power wire for operating said flood light and said running light.

2. The shallow water anchor of claim 1, wherein said flood light includes at least one LED.

3. The shallow water anchor of claim 2, wherein said at least one LED is a white LED.

4. The shallow water anchor of claim 2, wherein said at least one LED operates on 12 VDC.

5. The shallow water anchor of claim 1, wherein said running light further comprises a translucent housing.

6. The shallow water anchor of claim 5, wherein said translucent housing includes a channel dimensioned for receiving at least one LED.

7. The shallow water anchor of claim 5, wherein, said translucent housing is made of clear acrylic plastic.

8. The shallow water anchor of claim 5, wherein said translucent housing has a top lid and a bottom lid.

9. The shallow water anchor of claim 8, wherein said top lid and said bottom lid are made of acrylic.

10. The apparatus as in claim 1, wherein said mast is at least one meter long.

* * * * *